US005639086A

United States Patent [19]

Wolverton et al.

[11] Patent Number: 5,639,086

[45] Date of Patent: Jun. 17, 1997

[54] UNIVERSAL STRINGING MACHINE FOR SPORTS RACQUETS

[76] Inventors: Joseph J. Wolverton, 137 Review Ave., Lawrenceville, N.J. 08648; Michael F. Guerzini, 143 Birch Hollow Dr., Bordentown, N.J. 08505

[21] Appl. No.: 664,364

[22] Filed: Jun. 17, 1996

[51] Int. Cl.[6] ..... A63B 51/14

[52] U.S. Cl. ..... 473/555

[58] Field of Search ..... 273/73 R, 73 A, 273/73 B

[56] References Cited

U.S. PATENT DOCUMENTS

| | | | |
|---|---|---|---|
| 1,989,002 | 1/1935 | Doll | 273/73 A |
| 2,131,880 | 10/1938 | Becket | 273/73 B |
| 5,080,360 | 1/1992 | Longeat | 273/73 A |
| 5,186,505 | 2/1993 | Chu | 273/73 A |

*Primary Examiner*—William E. Stoll
*Attorney, Agent, or Firm*—White & Case

[57] ABSTRACT

A universal stringing machine has a pair of risers, having oppositely facing, V-shape bearing members for engaging opposed inside surfaces of a racquet frame. Preferably, each riser has a pair, and most preferably three, laterally spaced bearing members, in which each member can pivot between a first, e.g., up, position, for engaging the racquet, and a second, e.g., down, position, in which such member will be out of the way. Also, the two outside V-shaped bearing members are laterally adjustable toward and away from one another. In this manner, either the center bearing member, or the outside members, can be chosen to mount the racquet, depending upon racquet type, and also the distance between the outside bearing members can be adjusted so that the bearing members do not interfere with the strings. Preferably, the V-shaped engagement surface of the bearing members is covered with a plastic or elastomeric sleeve or cover, and can swivel about an axis perpendicular to the strings. Alternatively, retaining pads are swivel-mounted on the two "V" surfaces of the bearing member, to act as the contacts with the racquet frame. The V-configuration of the bearing surface acts to self-level non-constant height racquet frames, and also contacts the frame near the top and bottom, rather than in the middle of the span, to impart less stress.

20 Claims, 7 Drawing Sheets

UNIVERSAL STRINGING MACHINE FOR SPORTS RACQUETS

FIELD OF INVENTION

The present invention relates to stringing machines used for stringing and re-stringing sports racquets such as tennis racquets, squash racquets, racquetball racquets, and badminton racquets.

BACKGROUND OF THE INVENTION

Tennis racquets, squash racquets, racquetball racquets, and badminton racquets have a head portion, supporting a string bed, and a handle. Typically, the string bed is formed by a plurality of main strings, which extend generally parallel to the longitudinal axis of the racquet, and cross-strings which extend perpendicular to the racquet axis and which are interwoven with the main strings. Alternatively, in some racquets, the two sets of interwoven strings extend diagonally.

Although it is common to refer to a racquet as having a plurality of main strings and cross-strings, the racquet is actually strung with one or two lengths of string. A plurality of string holes are bored through the frame, and grommet pegs, formed on a grommet strip or bumper strip, are inserted through the holes to act as guides for, and to protect, the string. The string is threaded so as to extend between successive pairs of string holes lying on opposite sides of the frame. After the string crosses the string bed and exits one string hole, it runs along the outside surface of the frame, enters the next string hole, and then crosses the string bed in the opposite direction.

The strings need to be tensioned at a predetermined level, which is normally within a range set by the manufacturer for the particular racquet model. A racquet stringing machine is used for this purpose. A simplified drawing of a prior art racquet stringing machine is shown in FIG. 1. The machine includes a base 10, which is rotatably supported on a post 12. A pair of risers 14, 16 are supported on the base 10 so that they can be moved toward and away from one another in order to secure a racquet frame. Typically, the risers 14, 16 engage the inside surface of the frame at the tip (12 o'clock position) and throat (six o'clock position).

The machine includes a tensioning device 18, shown only schematically, which is either fixed or moveable relative to the post 12, and one or more string clamps 20. The lower end of each clamp 20 is slidable along a shaft 22. The ends of the shaft 22, in turn, are supported in guide blocks 24 for movement along a pair of opposed guides 26 (one of which is shown in FIG. 1), that extend perpendicular to the shaft 22. In this manner, the clamp 20 can be moved in any direction parallel to the plane of the base 10.

The string clamp 20 is used for stringing the cross-strings. A similar string clamp, supported on a similar pair of guide blocks, may be mounted to move along a second pair of guides 28, oriented perpendicular to the guides 26, for stringing the main strings.

In order to string a racquet, the racquet frame is first secured to the stringing machine. A length of string is then laced through the center main string holes. The amount of string laced through the holes depends on whether the racquet is to be strung with one or two lengths of string. If the racquet is be to strung with two lengths of string, then the amount of string laced through each pair of holes is equally divided. If the racquet is to be strung with one length of string, then the length of string needed to string one-half of the main strings is laced through one of the holes. The remainder of the string, enough to string the other half of the main strings plus all of the cross strings, is laced through the other pair of holes.

Stringing begins by securing one of the loose strings relative to the frame using a string clamp. The unclamped string is then tensioned by the tensioning device 18 and clamped to hold the tension. Each string segment is tensioned and clamped, one at a time, starting with the center main strings and working outwardly. In tensioning successive string segments, the base 10 can be rotated 180° in order to allow the tensioning device 18 to pull successive string segments alternately in opposite directions. The tensioning and clamping of the main strings preferably alternates from side-to-side so that the stress on the frame while installing the main strings is uniformly spread across the racquet face. After all the main strings are installed, one or both ends of the string are tied off depending on whether it is a one or two piece string job. The cross strings are then installed from either top to bottom, or bottom to top, depending on the manufacturer's recommendations. The first cross string is woven between the existing main strings and then tensioned and clamped to retain the tension. Each succeeding cross string is alternately woven, that is, woven over main strings that the preceding cross string was woven under and so forth. This procedure is continued until all cross strings are installed in order to form a uniform mesh.

When stringing the racquet, it is necessary to hold the racquet frame securely on the stringing machine. Older machines (i.e., pre-dating FIG. 1) had a very simple mounting system, in which a pair of metal posts were secured to the risers 14, 16. The racquet frame was positioned so that the metal posts were located inside of the frame head, at the 6 o'clock and 12 o'clock positions, respectively. The risers were then moved apart until the metal posts contacted the opposed inside surfaces of the frame, and the racquet was clamped down on the riser.

Typically, the main strings are strung first, so that the pulling force of the partially strung racquet, which would tend to cause the frame to deform (i.e., because there is no cross-string force yet to oppose it), could be born by the metal posts. Using metal posts to bear all of the force of the main strings was not a problem in older racquets, because most were made of solid wood, the inner hoop was flat (producing a relatively large contact area between the frame and the posts), and string tensions were relatively low.

Commonly owned U.S. Pat. No. 3,999,756 discloses a tennis racquet in which the geometric proportions of the conventional racquet were changed to provide a larger head and longer strings. Virtually all tennis racquets made today utilize such geometry. Commonly owned U.S. patent application Ser. No. 08/279,837 discloses a squash racquet geometry, widely used today, in which the throat bridge is eliminated and the strings extend down into the throat area, resulting in longer main strings. More recently, commonly owned U.S. Pat. Nos. 4,531,738 and 4,618,148 disclose racquetball racquets in which the geometry of the conventional racquet is changed to produce a larger head size, again resulting in longer strings. Most racquetball racquets today use this large head geometry.

As the head sizes of racquets increased, and the strings have become longer, the desired stringing tensions have increased. Also, today most sports racquets are made with composite materials, rather than wood or metal. Because such frames can be molded into any desired cross-sectional shape, the inside wall of the frame is usually curved rather than flat. As a result, the metal post of a conventional stringing machine tends to make point contact with the inside frame surface, creating a region of high stress. This problem is compounded by the fact that most composite racquet frames are hollow, and the contact point happens to be at the mid-span of the racquet contour, i.e., where the frame is weakest, especially with the higher cross-sections of today's widebody frames.

On typical modem stringing machines, such as those sold by the assignee under the trademarks Prince® and Ektelon®, the support system, referring again to FIG. 1, has a pair of retainers 30, 32, mounted on the tip riser 16 and a throat riser 14, respectively, and hold down clamps 34, 36, in place of the posts of the older stringing machines. A stringing machine of this type is also disclosed in commonly owned U.S. Pat. No. 4,417,729.

In order to secure the racquet frame properly, it is important to use retainers 30, 32 that have the proper geometry for the particular racquet model being strung. Known retainers have various shapes, such as an are, an inverse are, or V-shape. The Prince® stringing machine currently has around 15 different retainers, and the machine is designed to accept any of these interchangeable retainers.

While these custom retainers ensure that the racquet frame is clamped securely without being damaged, and while the ability to change retainers allows the machine to be used with virtually any racquet, it is inconvenient to have to stock so many different retainers, and there is the potential problem that some of the retainers will get lost or mislaid.

In addition to a mechanism to adjust the distance between the risers 14, 16, some machines permit the relative heights of the risers 14, 16 to be adjusted. The purpose of adjusting the relative heights of the risers is to level the string bed in racquets where the frame heights at the tip and throat midspan are different. Absent a way to adjust the relative heights of the risers, the string bed in such a racquet would not be level. It is desirable to keep the string bed level when stringing the racquet because the string clamps work best if the string bed is level, and because the frictional forces between the string and the grommets will be more uniform, allowing the strings to be tensioned more uniformly and accurately.

In order to mount a racquet, after selecting and installing the proper retainers, the distance between the risers is adjusted to leave a little space between the retainer and the racquet. The height of the risers is then adjusted (if such feature is available on the machine) to compensate for any height differences between the tip and throat.

The tip of the racquet is then secured to the tip riser 16, by positioning the frame between the retainers 30 and tightening the clamp 34. Once this is done, the final adjustment of the distance between the risers is made, so that the throat will be properly positioned relative to the throat retainers 32 when the throat retainer clamp 36 is tightened. The throat is then secured to riser 14 by tightening clamp 36. Such procedure can require substantial time in terms of adjusting and sometimes readjusting before actual stringing can begin.

A modem version of the old type of stringing machine, which includes upright posts rather than retainers for securing the frame, is sold under the name Babolat 3000. The metal posts are covered by a piece of molded nylon which is radiused to protect the racquet's inner hoop. The machine also has two pairs of arms, or outriggers, with V-shaped blocks mounted on the ends. These outriggers are positioned on the outside of the racquet frame so that the V-shaped blocks contact the outside surface of the racquet frame at the 10 o'clock, 2 o'clock, 4 o'clock, and 8 o'clock positions. This mechanism is described further in U.S. Pat. No. 5,026,055.

A racquet is mounted on the Babolat machine by opening the outriggers, and reducing the distance between the metal retaining posts until the frame can be positioned between the outriggers and the retaining posts can fit inside the tip and throat areas. The racquet is then laid on the risers, and both sets of outriggers are adjusted inwardly until they make contact with and raise the racquet off the risers, centering it in the V-blocks. At this point, the retaining posts are moved away from one another until they make firm contact at the 12 o'clock and 6 o'clock positions of the racquet head.

As discussed above, when the racquet is partially strung, the main strings will pull the tip and heel regions toward one another, which force is resisted by the retainers or posts at the tip and throat regions. The Prince and Ektelon stringing machines support the racquet frame only at the 6:00 and 12:00 positions, in order to allow the racquet to breathe naturally and without restriction. In the case of the Babolat machine, the purpose of the outriggers is to attempt to keep the racquet head from changing shape during the time the racquet is only partially strung.

While the outriggers act to self-level the string bed, a Babolat-type machine has certain drawbacks. The type of two-point mounting in the Babolat-type machine, at the 6 o'clock and 12 o'clock positions, is undesirable because a two-point loading alone cannot stabilize the racquet. Thus, outriggers are required to prevent twisting and side-to-side movement. However, outriggers are rather bulky, tend to get in the way when stringing the racquet, and increase the amount of time needed to mount the racquet on the machine. Also, it would be difficult to string a racquet with an odd number of main strings, because the center main string would extend along the centerline of the head, where the two retaining posts are located.

SUMMARY OF THE INVENTION

A universal stringing machine has a pair of risers, having bearing members with outwardly facing, V-shaped surfaces for engaging opposed inside surfaces of a racquet frame. Preferably, each riser has a pair of laterally spaced bearing members that are adjustable toward and away from one another. Also, one or both risers preferably has a third, fixed bearing member, positioned between the adjustable pair, and each bearing member can pivot between a first position, for engaging the racquet, and a second position, in which such member will be out of the way. In this manner, either the center bearing member, or the two outside bearing members, can be chosen to mount the racquet, depending upon racquet type, and when the outside pair is used the distance between the outside bearing members can be adjusted so that the bearing members are located between the string holes and therefore do not interfere with stringing.

The V-configuration of the engagement surface produces several desirable results. First, it acts to self-level the racquet, even in the case of non-constant height racquet frames, which eliminates the need for a mechanism to make the riser height adjustable. Also, due to the V-shaped engagement surface, each bearing member will contact the racquet frame at two vertically spaced locations, thereby reducing the stress applied at each location of the frame wall by one-half compared to a two-point loading of the prior art. Moreover, the "V" surfaces make contact with the frame near the top and bottom of the sidewall where, due to the wall's curvature, the effective wall thickness and strength, in the direction of the racquet axis (i.e., the direction opposing the outward force of the bearing members) is greatest, rather than in the middle of the hollow span where the wall thickness and strength, in the axial direction, is least.

Thus, in accordance with the present invention, the tip and throat of the racquet are supported either by one or by two bearing members, each having a V-shaped surface that engages the racquet frame at two locations, rather than one, and thereby even where only a single bearing member is used the amount of local stress on the frame is reduced. Also, as noted above, the engagement points are near the top and bottom of the hollow tube frame, where the racquet frame is able to resist stress more effectively.

The V-shaped surface also act to automatically center the string bed at the center of the "V", thereby self-levelling the string bed and locating the racquet frame very precisely. As string tension is applied, and the tip and throat are pulled toward one another, the frame sinks into the V-shaped surfaces, seating the frame very securely against movement. The present invention therefore allows the racquet to be mounted much faster than known stringing machines. And, because in most applications a pair of bearing members can be used at both the tip and throat, the racquet will be held very securely in the plane of stringing, without the need for extraneous clamps or other devices (such as outriggers) which can interfere with stringing of the racquet.

Preferably, a protective cover, made of plastic or elastomeric material, is placed over the V-shaped surface to prevent direct contact between the metal bearing member and the racquet frame. Also, in a preferred embodiment the contact surface of the bearing member can swivel, to a limited extent, relative to the string bed, so that it can lie flush against the curved racquet frame surface. In one embodiment, a protective pad is pivotably mounted on each of the two "V" surfaces. In another embodiment, the bearing member itself is mounted so that it can swivel on its mounting block.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
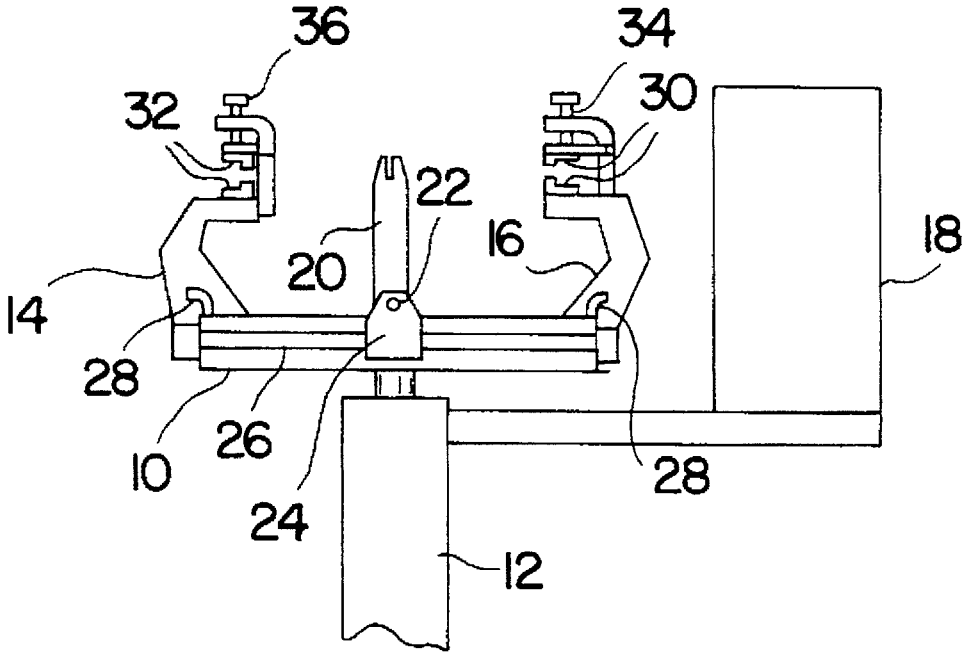
FIG. 1 PRIOR ART
FIG. 1 is a front view of a prior art racquet stringing machine.
Figure 2:
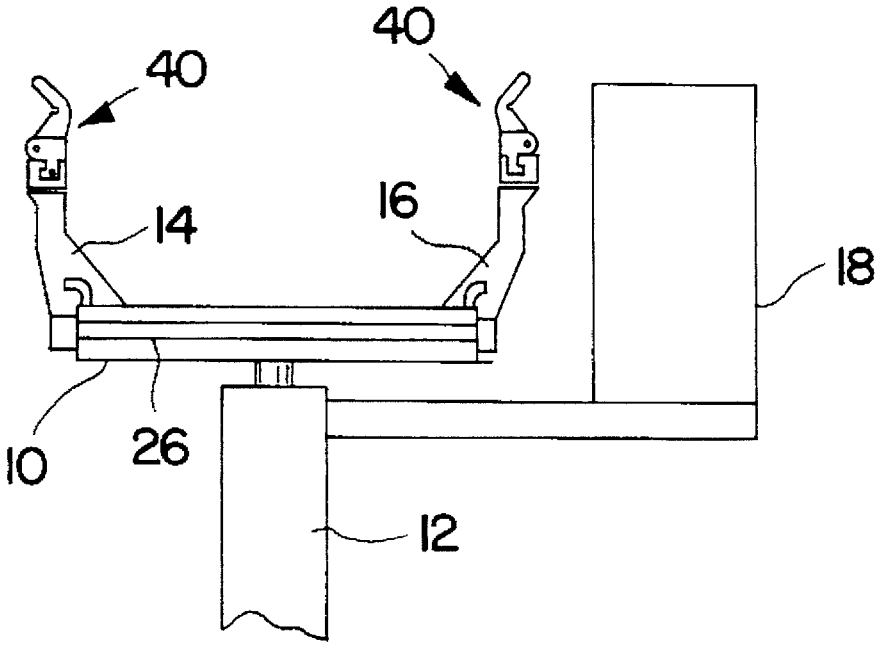
FIG. 2 is a front view of a racquet stringing machine according to the invention.

FIG. 2 shows an example of a stringing machine, which is similar to FIG. 1 except that the machine employs a pair of V-block assemblies 40 in place of retainers 30, 32 and hold-down clamps 34, 38. An exemplary embodiment of a V-block assembly 40 is shown and described in more detail in connection with FIGS. 3–11. Other exemplary embodiments are shown in FIGS. 12–18.

Referring to the example shown in FIGS. 3–11, the V-block assembly 40 includes a base 42 containing a guide channel 44. A stationary V-block 46 includes a V-block pivot base 48, which is fixed in the channel 44 by any suitable means, such as screws, adhesive, or welding, and a bearing member 50 having a V-shaped surface 51. The bearing member 50 is pivotably retained on the V-block pivot base 48 by pivot pin 53. The base 42 and V-block pivot bases 48 are preferably made of a high strength material such as metal. The V-shape bearing member 50 is also made of a high strength material, e.g., steel, but preferably the V-shaped surface 51 will engage the racquet frame is covered with a softer material such as nylon so as avoid damaging the racquet surface.

Figure 6:
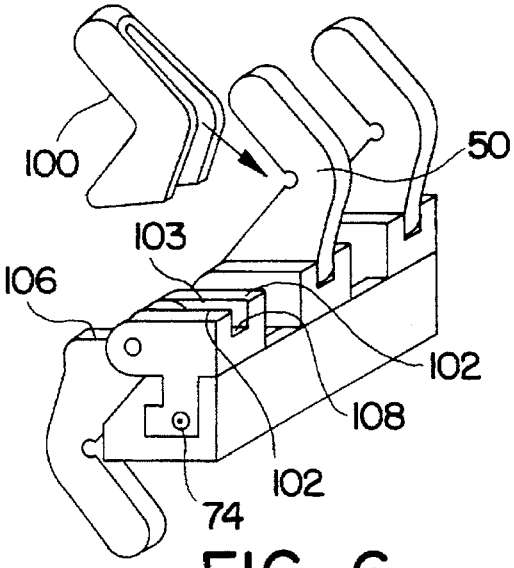
FIG. 6 is a rear perspective view of the V-block assembly.

FIG. 6 shows an example of an elastometic or plastic cover or sleeve 100, which can be slipped over the bearing blocks 50. The covers 100, which can be either removably or permanently affixed to the bearing blocks 50, form the contact surfaces between the racquet frame and the metal bearing members 50 so as to prevent direct contact and protect the surface of the racquet. The sleeve 100 shown is only exemplary, and other types of sleeves, boots, surface coatings, or the like, may be employed to provide the V-shaped surface with a cushioned coating.

The V-block assembly 40 also includes a pair of adjustable V-blocks 52*a*, 52*b*. Each of the adjustable V-blocks 52*a*, 52*b* includes a V-block pivot base 54, which is similar to base 48. The V-block pivot bases 54 are shaped to be received in the guide channel 44 for sliding movement along the guide channel 44. Each adjustable V-block 52*a*, 52*b* also includes a bearing member 56 having a V-shaped engagement surface 51 that is pivotably retained on the V-block pivot base 54 in the same manner as bearing member 50. Preferably, the V-shaped engagement surfaces 51 of the bearing members 56 are covered by sleeves 100 or other protective covering.

Figure 3:
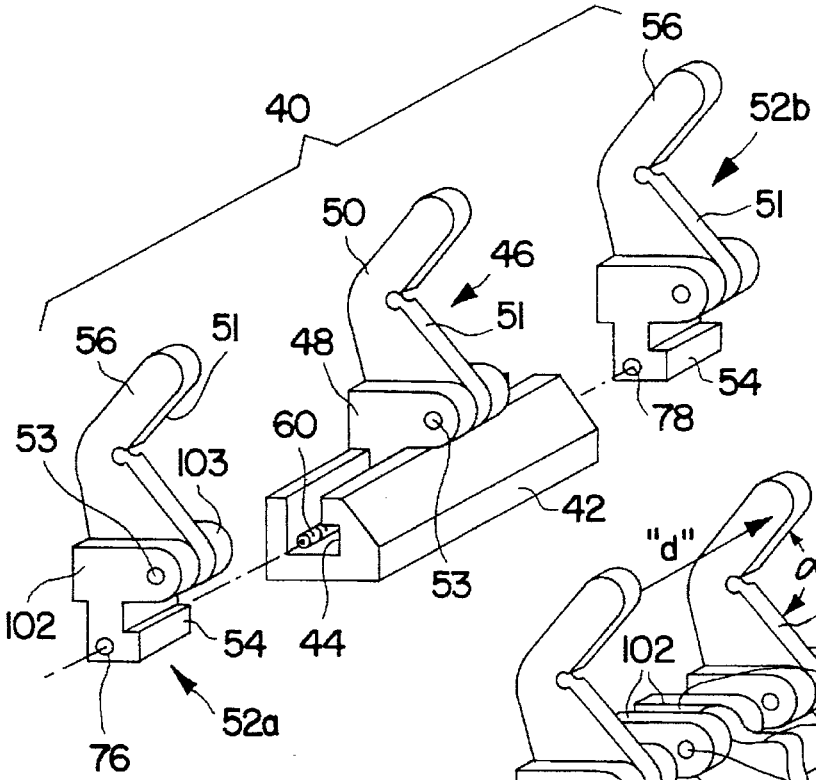
FIG. 3 is a perspective, exploded view of a V-block assembly for use in the stringing machine of FIG. 2.
Figure 4:
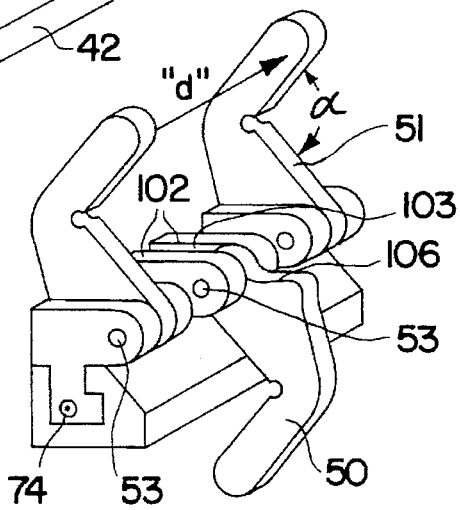
FIGS. 4 and 5 are perspective views of the V-block assembly, showing the adjustable V-blocks in two different positions.
Figure 5:
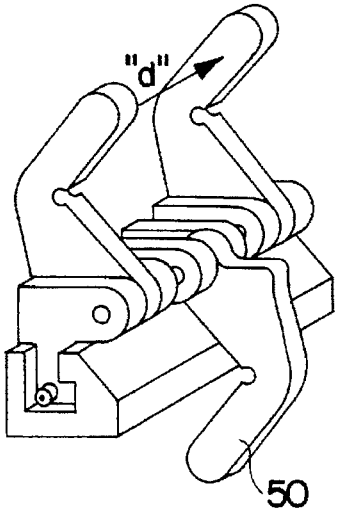
Figure 7:
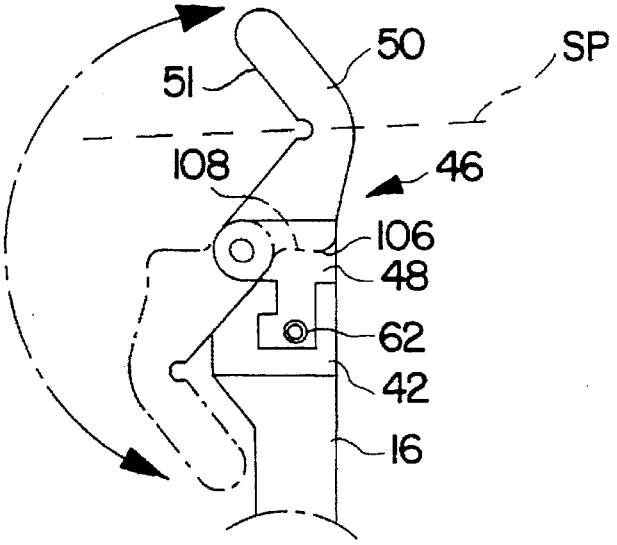
FIG. 7 is an end view of the partially assembled V-block assembly.

The V-shaped bearing members 50, 56 are pivotable in a plane perpendicular to the guide channel 44, between an up position, shown in FIG. 3, and a down position. FIGS. 4 and 5 show the center bearing member 50 in its down position. FIG. 6 shows one of the adjustable bearing members 56 in its down position, and the other of the adjustable members 56 and the center bearing member 50 in their up position. FIG. 7 shows the center bearing member 50 in both positions, the down position being depicted in broken lines.

As shown, each of the V-block pivot bases 48, 54 includes a pair of sidewalls 102, defining a retaining channel 103 (see FIG. 4). The bearing members 50, 56 are pivotably secured in the channel 103 by pivot pin 53. When in their up position, a portion of the bearing member 50, 56 is sandwiched between the sidewalls 102, and the bottom surface 106 of the bearing member 50, 56 rests against the bottom surface 108 of the channel 103.

In its up position, referring to FIG. 7, the V-shaped surface 51 intersects a plane "SP" that, when a racquet is mounted in the machine, will contain the string bed. When rotated to its down position, the V-shaped surface 51 does not intersect this plane, and as shown the bearing member 50 will not interfere with racquet mounting or stringing.

As shown in FIG. 7, which is an end view of the base 42, with the center, fixed V-block assembly 46 only, the V-block pivot base 48 of the stationary V-block 46 includes an unthreaded bore 62 that extends parallel to the channel 44. The unthreaded bore receives a double-acting lead screw 60 (not shown in FIG. 7) to allow free rotation thereof.

Figure 11:
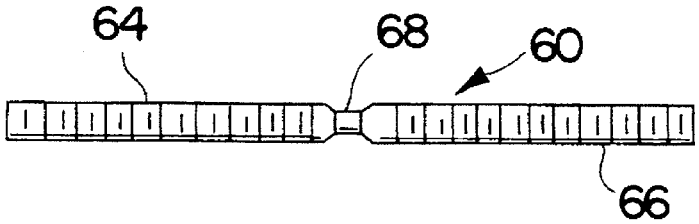
FIG. 11 is a front view of a double-acting lead screw, used in the exemplary embodiment.

The lead screw 60 extends axially along the guide channel 44, as shown in FIG. 3. Referring to FIG. 11, the lead screw 60 includes a right-hand threaded end portion 64 and a left-hand threaded end portion 66 at the opposite end. An annular channel 68 is formed in the middle of lead screw 60. The channel allows the lead screw to be secured in the bore 62 of the stationary V-block pivot base 48, for example using a key or a set screw, to prevent axial movement of the lead screw 60 while at the same time permitting the screw to turn. As best seen in FIG. 8*a*, the outwardly facing ends of the screw 60 are provided with a hexagonal socket 70, which can receive an Allen wrench to adjust the screw. Alternate means for turning the screw, such as a square socket, a Phillips head slot, a flathead screwdriver slot, an outwardly projecting fitting, or a projecting knob, may he employed as well.

The V-block pivot base 54 of one of the adjustable V-blocks, e.g., block 52*a*, is provided with a right-hand threaded bore 76 that extends parallel to the axis of the guide channel 44, whereas the V-block pivot base 54 of the other adjustable V-block 52*b* is provided with a left-hand threaded bore 78.

To assemble the unit 40, the lead screw is axially secured in the bore 62, and the stationary V-block pivot base 48 is secured in the guide channel 44, at the center of the base 42. The right-hand threaded portion 64 of lead screw 60 is threaded through the right-hand threaded bore 76 of V-block 52*a*, while at the same time the left-hand threaded portion 66 of the screw 60 is threaded through the left-hand threaded bore 78 of V-block 52*b*.

As thus can be appreciated, turning of the lead screw 60 causes reciprocal motion of the two adjustable V-blocks 52*a*, 52*b*, thereby adjusting the axial distance "d" between the two blocks in a synchronous manner, as shown by FIGS. 4–5.

The internal angle $\alpha$ (see FIG. 4) of the V-shaped engagement surfaces 51 is preferably between 100° and 150°, and most preferably around 120°.

Figure 8:
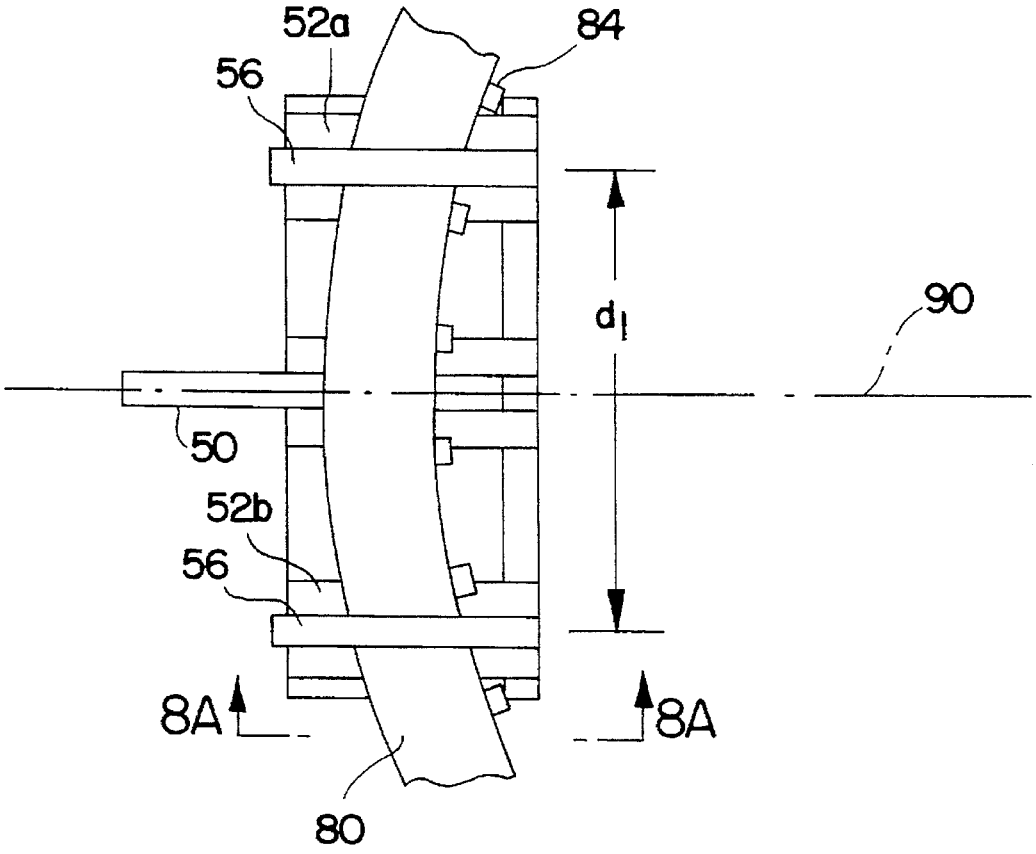
FIGS. 8, 9, and 10 are top views of the V-block assembly engaging three different racquet models.
Figure 8A:
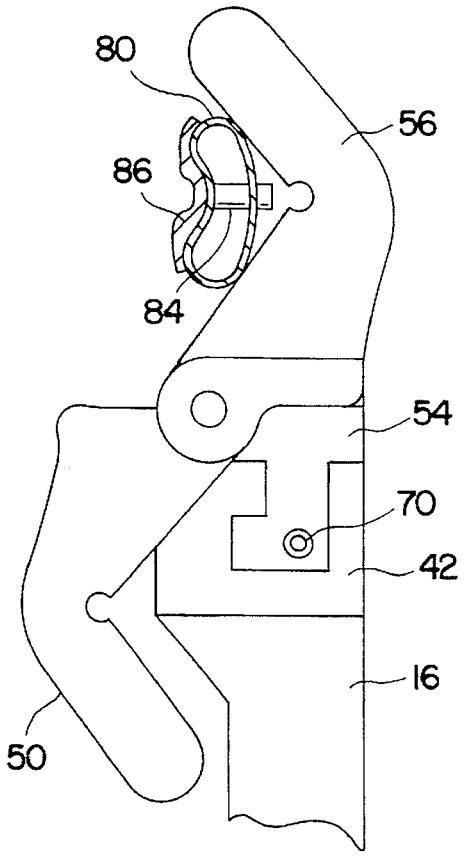
FIG. 8*a* is an end view of the V-block assembly, and sectional view of the racquet, taken through lines 8*a*—8*a* of FIG. 8.
Figure 9:
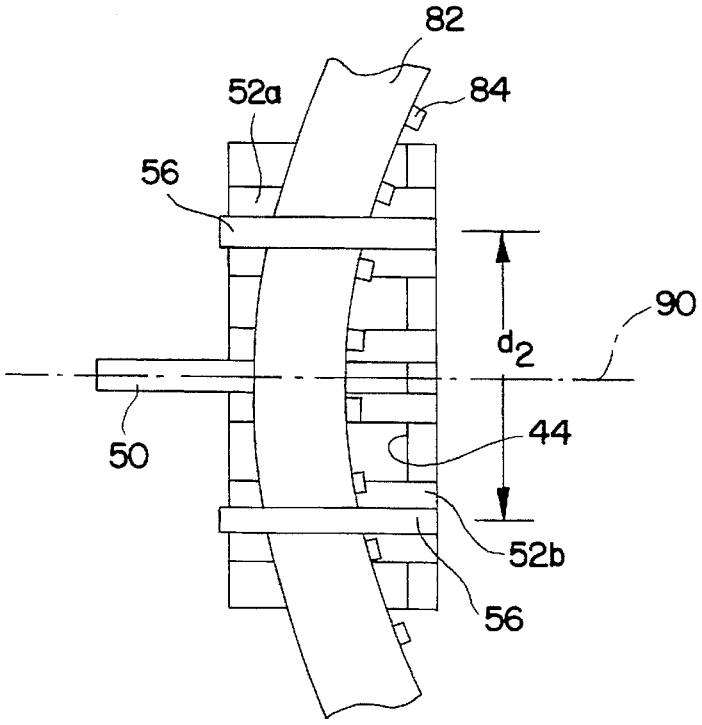
Figure 10:
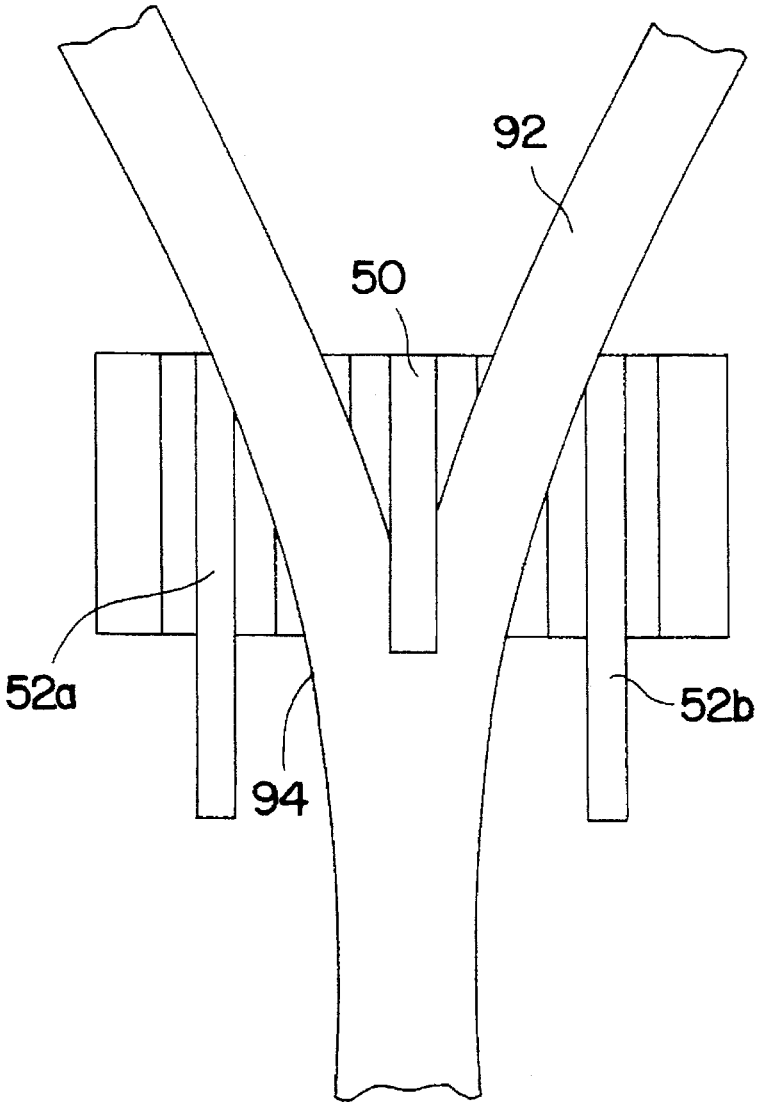

FIGS. 8–10 illustrate how the V-block assembly 40 can be adjusted to engage three different racquets. FIGS. 8 and 9 show the tip regions of two tennis racquets 80, 82, where the spacing between the main strings is different. The figures depict the racquet frame just prior to stringing, with conventional grommet pegs 84 projecting through the racquet frame for a short distance into the stringing area of the head. As shown in FIG. 8*a*, the grommet pegs 84 project through the hollow frame 80 from a conventional bumper strip 86 positioned against the outside surface of the frame 80.

In both FIGS. 8 and 9, the middle V-shaped bearing member 50 has been pivoted to its down position, and the two adjustable V-shaped bearing members 56 are in their up positions, in the manner of FIGS. 4–5. However, in FIG. 9 the adjustable V-blocks 52*a*, 52*b* have been moved closer together than in FIG. 8, i.e., $d_2$ is less than $d_1$, so that the V-shaped bearing members 56 lie between two adjacent grommet pegs 84. Because the lead screw 60 causes both V-blocks 52*a*, 52*b* to move the same distance, they will always remain an equal distance from the racquet axis 90 (and riser axis, which normally intersects the racquet axis).

FIG. 10 shows a racquet 92 where the sides of head frame converge in the throat region 94 in a sharp V-configuration, which is common in squash and racquetball racquets. In order to mount such a racquet in the present stringing machine, the center V-shaped bearing member 50 is rotated up, and the two side V-shaped bearing members 52*a*, 52*b* are rotated down. In this manner, the center V-shaped bearing member 50 engages the frame at the base of the throat, and the other two members 56, 58 remain out of the way.

The preferred embodiment of the present invention both offers an option of which V-blocks are to be used, and allows the distance between the pair of outlying V-blocks to be adjusted for the particular racquet so that the V-blocks do not interfere with stringing.

Figure 12:
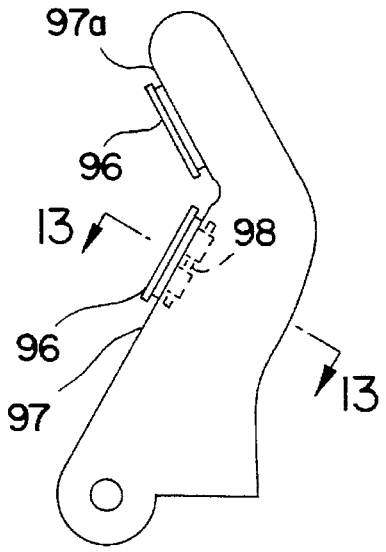
FIG. 12 is a side view of an alternative embodiment of a V-bearing for use in the V-block assembly.
Figure 13:
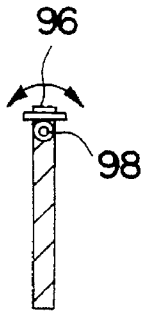
FIG. 13 is a sectional view of the V-bearing of FIG. 12, taken in the direction of arrows 13—13.

FIGS. 12–13 shows an alternative embodiment, in which a retaining pad 96 is secured to each of the two surface portions 97, 97*a* of the "V" clamp. As shown, the retaining pads 96 are mounted by pivot pins 98, which allow the pads 96 to swivel about an axis that is parallel to the plane of the respective surface portion 97 or 97*a*, the two swivel axes lying in the same plane.

Figure 14:
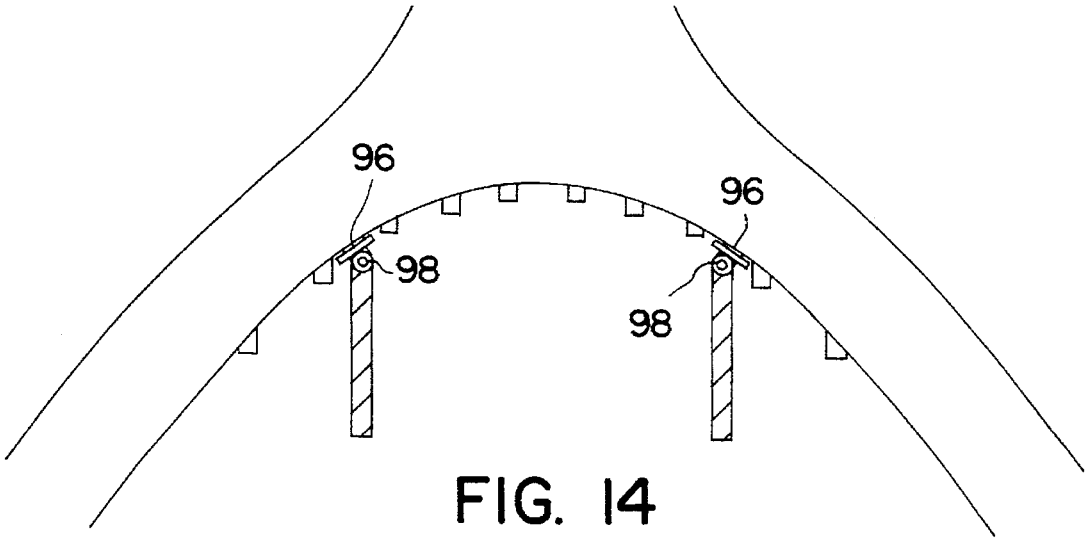
FIGS. 14–15 show V-bearings according to FIGS. 12–13 seated against two different racquet frames.
Figure 15:
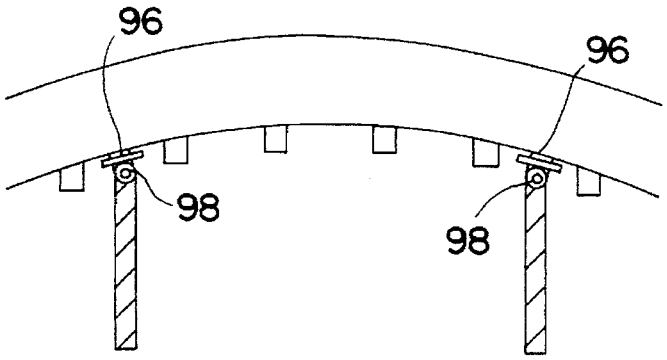

FIGS. 14–15 show a clamp mounting of two different racquets, where the V-clamps have retaining pads 96. As shown, by being allowed to swivel, the retaining pads 96 will make firm and complete contact against the curving racquet frame, regardless of the angle of the frame, relative to its axis, at the point of contact (which as shown in FIGS. 14–15 can vary significantly among different racquet models).

Figure 16:
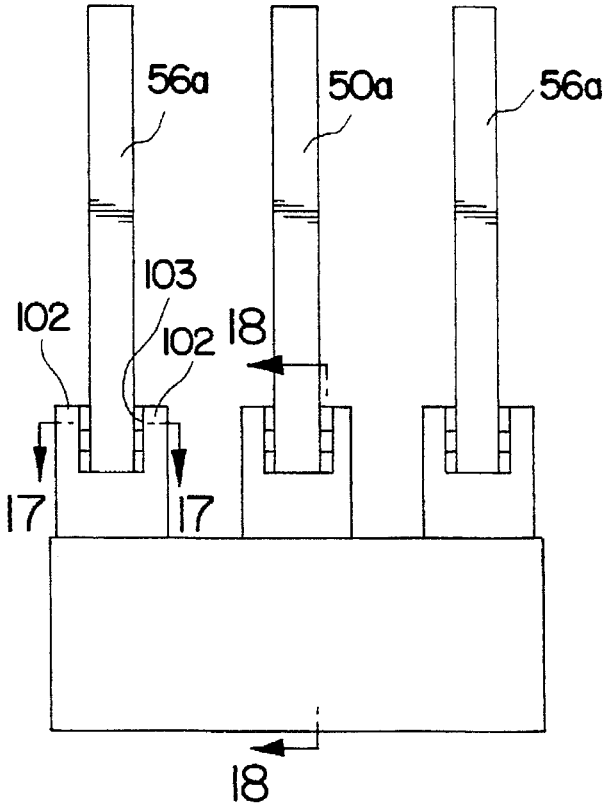
FIG. 16 is a rear view of an alternative embodiment of a V-block assembly.
Figure 17:
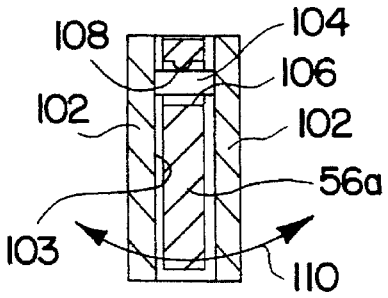
FIGS. 17–18 are sectional views, taken along lines 17—17 and 18—18, respectively, of FIG. 16.
Figure 18:
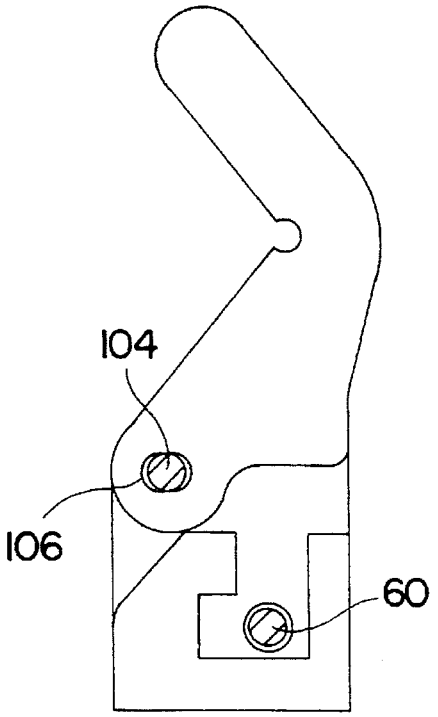

As an alternative embodiment, the bearing members 50 and 56 themselves are mounted in a manner that they can swivel, to a small extent, about an axis that is generally perpendicular to the string bed, i.e., parallel to the risers. FIGS. 16–18 show an exemplary embodiment in which clearance is left between the sides of the bearing members 50*a*, 56*a* and the sidewalls 102 of the retaining channels 103. As in the case of the prior embodiments, the bearing members 50*a*, 56*a* are pivotable on pin 104 between an up and down position, however the holes 106 formed in the bearing members 50*a*, 56*a* for receiving pin 104 are eccentric. Also, a fulcrum projection 108 is formed on the inside of hole 106, which allows the bearing members 50*a*, 56*a* to swivel a small amount, as shown by arrow 110, about the pin 104, in a direction parallel to the string bed. This swivelling ability allows the V-shape bearing surface, which is preferably covered with a pad or cover 100, to seat flush against the frame's curving inside surface, in a manner similar to pads 96 as shown in FIGS. 12–15.

The foregoing represents preferred embodiments of the invention. Variations and modifications will be apparent to persons skilled in the art, without departing from the inventive concepts disclosed herein. For example, rather than pivoting forward into the down position, the V-shaped bearing members 50, 56, could fold down sideways, or could be moved between engaging and disengaging positions in some other manner, such as by making the unused V-bearings removable. Also, while the invention has been described in connection with the Ektelon® stringing machine, the invention may be employed with any stringing machine having risers for securing the frame, such as the Babolat 3000. Also, while an example has been given of a mechanism to selectively move the adjustable V-blocks 52*a*, 52*b*, any suitable mechanism may be employed.

Finally, while the preferred embodiment employs three selectively engagable V-blocks, V-block assemblies employing fewer than three V-blocks, e.g., two or one, or more than three V-blocks may be used. Thus, for example, a V-block assembly having two V-blocks, in which one or both are moveable toward and away from the other block, may be employed. In addition, it may be desirable to employ different V-block configurations at the throat and tip ends of the racquet. For example, it may be desirable at the throat to provide three fold-down bearing members, to allow the option to use either the outside, adjustable pair (e.g., if the throat has a round profile) or the center bearing member (e.g., to secure a Y-shaped throat area as shown in FIG. 10), whereas at the tip portion, which would not normally contain a sharp angle, provide only a laterally adjustable pair, which do not need a fold-down capability. All such modifications and variations are intended to be within the skill of the art, as defined in the following claims.

We claim:

1. In a stringing machine for a sports racquet, said machine having a pair of risers spaced apart along a stringing machine axis, each riser having a riser axis generally perpendicular to said stringing machine axis, said risers supporting a pair of bearing members for engaging axially opposed inside surfaces of a racquet head in order to secure such racquet on the machine, the improvement wherein said bearing members have outwardly facing V-shaped surfaces for engaging opposed inside surfaces of a racquet frame at the tip and throat region, and wherein each V-shaped surface is adapted to engage each such frame surface at a pair of locations spaced generally parallel to said riser axis.

2. A stringing machine according to claim 1, wherein at least one said riser has a first pair of bearing members, laterally spaced apart relative to said riser axis, for engaging a racquet frame at laterally spaced locations, each bearing member of said first pair having a V-shaped surface for engaging the frame at a pair of spaced locations.

3. A stringing machine according to claim 2, further comprising adjustment means for adjusting the lateral spacing between said first pair of bearing members.

4. A stringing machine according to claim 3, wherein said adjustment means maintains the bearing members of said first pair equidistant from the riser axis of said at least one riser.

5. A stringing machine according to claim 4, further comprising mounting means for moving at least one bearing member relative to its associated riser between a first position, in which said V-shaped surface intersects a first plane that, when a racquet is mounted, contains the racquet's string bed, and a second position in which the said V-shaped surface does not intersect said first plane, and wherein in said second position, the at least one bearing member will not interfere with racquet mounting or stringing.

6. A stringing machine according to claim 5, wherein said at least one bearing member is pivotable about a pivot axis fixed relative to said riser for moving between said first and second positions.

7. A stringing machine according to claim 6, wherein said pivot axis is parallel to said first plane and is perpendicular to said stringing machine axis.

8. A stringing machine according to claim 7, wherein said at least one riser supports a third bearing member having a V-shaped surface, centered between said first pair of bearing members, at least generally along said riser axis, and wherein said first pair of bearing members and said third bearing member are each moveable between said first and second positions.

9. A stringing machine according to claim 2, further comprising mounting means for moving at least one bearing member relative to its associated riser between a first position, in which said V-shaped surface intersects a first plane that, when a racquet is mounted, contains the racquet's string bed, and a second position in which the said V-shaped surface does not intersect said first plane, and wherein in said second position, the at least one bearing member will not interfere with racquet mounting or stringing.

10. A stringing machine according to claim 9, wherein said bearing members are pivotable about a pivot axis fixed relative to said riser for moving between said first and second positions.

11. A stringing machine according to claim 10, wherein said pivot axis is parallel to said first plane and is perpendicular to said stringing machine axis.

12. A stringing machine according to claim 11, wherein said at least one riser has a third bearing member having a V-shaped surface, centered between said first pair of bearing members, at least generally along said riser axis, and wherein said first pair of bearing members and said third bearing member are pivotable between said first and second positions.

13. A stringing machine according to claim 1, comprising swivel mounting means for permitting at least one said bearing member to swivel about a swivel axis perpendicular to said string plane.

14. A stringing machine according to claim 1, wherein said bearing members include cover members over said V-shaped surfaces for contacting and protecting the racquet surfaces.

15. A stringing machine according to claim 1, wherein each said riser has a pair of laterally spaced bearing members for engaging a racquet frame at laterally spaced locations, each bearing member having a V-shaped surface for engaging the racquet frame at a pair of vertically spaced locations.

16. A stringing machine according to claim 15, further comprising adjustment means for adjusting the lateral spacing between each said pair of bearing members for maintaining said bearing members equidistant from said riser axis.

17. A stringing machine according to claim 16, wherein at least one riser has a third bearing member having a V-shaped surface, centered between said pair of bearing members associated with said at least one riser, at least generally along said riser axis, further comprising mounting means associated with each of the said three bearing members for selectively moving the said three bearing members between a first position, in which said V-shaped surface intersects a first plane that, when a racquet is mounted, contains the racquet's string bed, and a second position in which the said V-shaped surface does not intersect said first plane, and wherein, in said second position, the bearing member will not interfere with racquet mounting or stringing.

18. A stringing machine according to claim 17, further comprising swivel mounting means for supporting said bearing members for swivelling about an axis parallel to its respective riser axis.

19. A stringing machine according to claim 18, wherein another said riser has a third bearing member, centered between said pair of bearing members associated with said another riser, at least generally along said another riser axis, and comprising mounting means for mounting all three of said bearing members associated with said other riser to be selectively moveable, relative to said riser, between said first and second positions.

20. A stringing machine according to claim 1, wherein said V-shape surfaces are formed of first and second surface portions lying generally in planes angled relative to one another, and further comprising a retaining pad associated with each surface portion, and means for securing each retaining pad to its respective surface portion for swivelling about an axis which is at least generally parallel to the respective planes.

* * * * *

UNITED STATES PATENT AND TRADEMARK OFFICE

CERTIFICATE OF CORRECTION

PATENT NO. : 5,639,086

DATED : June 17, 1997

INVENTOR(S) : Wolverton et al.

It is certified that error appears in the above-identified patent and that said Letters Patent is hereby corrected as shown below:

Cover page: After the "Inventors" segment, add:

-- [73] Assignee: Prince Sports Group, Inc.
Bordentown, N.J. --

Signed and Sealed this

Twenty-sixth Day of May, 1998

*Attest:*

*Attesting Officer*

BRUCE LEHMAN

*Commissioner of Patents and Trademarks*